United States Patent [19]

Stohrer, Jr. et al.

[11] 4,055,132

[45] Oct. 25, 1977

[54] METHOD OF FORMING PORTS IN A FUEL BURNER

[75] Inventors: Charles E. Stohrer, Jr., Hickory Hills; Norman M. Huff, Chicago, both of Ill.; Leonard J. Micinski, Mishawaka, Ind.

[73] Assignee: Harper-Wyman Company, Hinsdale, Ill.

[21] Appl. No.: 668,294

[22] Filed: Mar. 18, 1976

[51] Int. Cl.[2] ..... B21D 28/10

[52] U.S. Cl. ..... 113/116 EE; 72/326; 126/39 E; 431/349

[58] Field of Search ..... 113/116 DD, 116 EE; 126/39 R, 39 E; 29/157 R, 163.5 R; 431/349; 72/325, 326

[56] References Cited

U.S. PATENT DOCUMENTS

| | | | |
|---|---|---|---|
| 146,665 | 1/1874 | Foxwell | 72/326 |
| 1,044,283 | 11/1912 | Stanger | 72/325 |
| 2,044,528 | 6/1936 | Guhl | 126/39 E |
| 2,220,247 | 11/1940 | Kochendorfer et al. | 431/349 |
| 2,590,807 | 3/1952 | Voslamber | 29/163.5 R |
| 3,386,431 | 6/1968 | Branson | 126/39 R |

FOREIGN PATENT DOCUMENTS

| | | | |
|---|---|---|---|
| 1,313,721 | 4/1973 | United Kingdom | 431/349 |

*Primary Examiner*—Lowell A. Larson
*Attorney, Agent, or Firm*—Mason, Kolehmainen, Rathburn & Wyss

[57] ABSTRACT

A method of forming ports in a fuel burner wherein the ports are formed in a single stroke employing a tool having a plurality of punch members arranged in an array corresponding to the configuration of the burner body that may be a complex shape. The burner body and tool structure are supported for relative movement toward and away from each other. The tool structure and body are moved toward one another to form the array of ports in the burner body in a single relative motion. This motion is terminated before the material punched by the tool is severed from the burner body.

4 Claims, 6 Drawing Figures

METHOD OF FORMING PORTS IN A FUEL BURNER

BACKGROUND OF THE INVENTION

A. Field of the Invention

The present invention relates to a new and improved method for fabricating ports in a fuel burner wherein the ports are fabricated in a single movement of the tool relative to the burner.

B. Description of the Prior Art

Presently, many different methods of fabricating ports in a sheet metal fuel burner are available. However, these methods require a multiplicity of steps and movements to fabricate or cut the ports in a complete burner body, particularly if the burner body is of a complex configuration; for example, and H-shaped configuration useful in gas fired barbecue cookers.

Of the different procedures followed, some employ drilling of the various ports in the burner body. Drilled ports in thin sheet metal vary from a true round hole and have an irregular burr or finn carried forward by the drill which results in uneven burning and ragged flames. Moreover, such a process is expensive and requires a plurality of steps or separate manufacturing operations for fabricating several ports, particularly in a complex configuration.

Another method utilizes a mandril and a puneh such as that illustrated in U.S. Pat. No. 3,386,431. This patent also discloses the use of a roller or punch wheel; however, this method has the disadvantage that an elaborate operation is necessary for fabricating ports in a burner having a complex configuration.

SUMMARY OF THE INVENTION

An object of the present invention is to provide a new and improved method for fabricating ports in a fuel burner body.

Another object of the present invention is to provide a new and improved method for fabricating ports in a fuel burner body having a complex configuration wherein the ports are fabricated in a single stroke in one direction without the use of cams, or other means to obtain porting around the complete periphery of the burner.

Another object of the present invention is to provide a new and improved method for fabricating ports in a burner body having a complex nonlinear configuration in a single motion without shearing loose slugs that must be cleared from the punch whereby the ports have tabs that secondarily assist in obtaining a desirable direction of fuel flow out of the ports.

Briefly, the present invention is directed to a new and improved method for fabricating ports in a burner body of a complex configuration wherein the fabrication process is completed in one manufacturing operation. The present invention employs a tool structure having a plurality of punch members arranged in an array corresponding to the port array desired to be fabricated in the burner body. The tool is moved relative to a burner body in a single motion, punching a plurality of ports in the desired array. This motion is terminated before the material punched by the punch members is severed from the body. Tabs formed by this material extend into the interior of the burner body remaining attached to the body thus eliminating the need to incorporate passages in the punch for removal of sheared out slugs.

BRIEF DESCRIPTION OF THE DRAWING

The above and other objects and advantages and novel features of the present invention will become apparent from the following detailed description of a preferred embodiment of the invention illustrated in the accompanying drawing wherein.

DESCRIPTION OF THE PREFERRED EMBODIMENT

Figure 1:
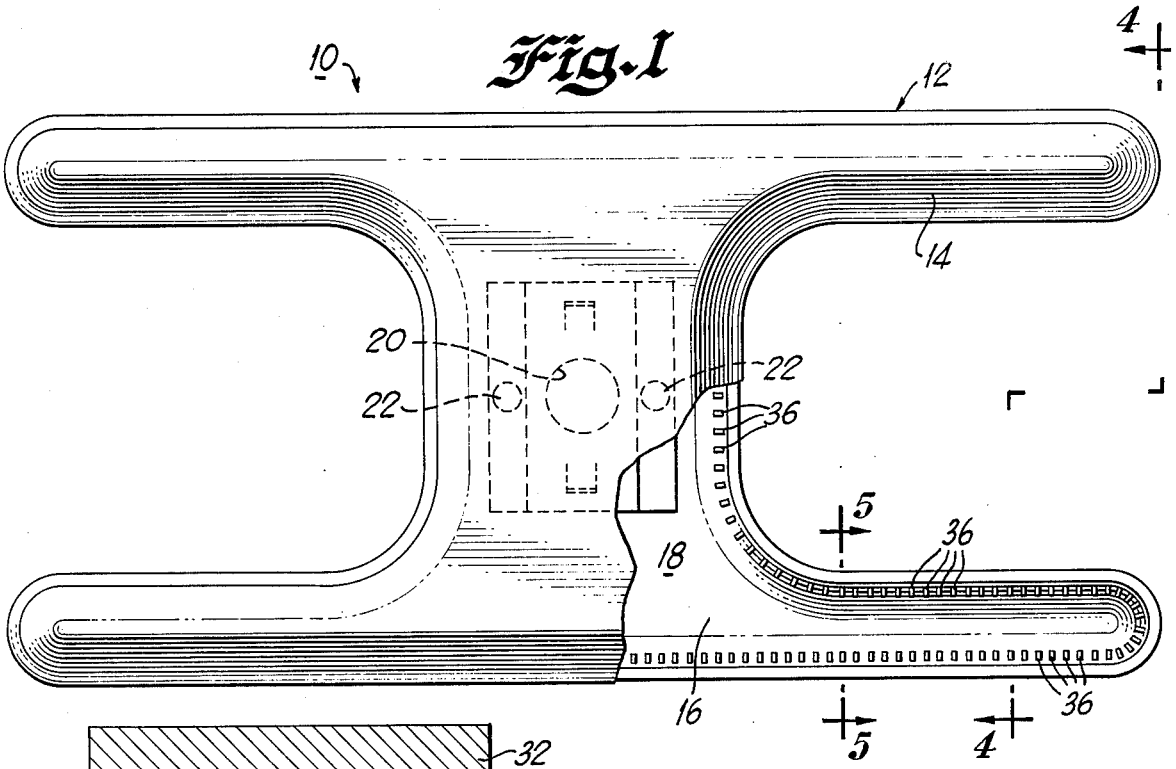
FIG. 1 is a partially cut-away, plan view of a burner having ports fabricated in accordance with the principles of the present invention.

Illustrated in the drawing is a fuel burner 10 having a complex configuration, in the preferred embodiment illustrated as an H-shape. A fuel burner of this configuration may be utilized in a gas barbecue grill or similar device. The term "complex" is intended to connote a burner body shape requiring a port array other than a straight line. Examples are a circular or square burner as well as the H-shape illustrated in the drawing.

The burner 10 includes a housing 12 having upper and lower portions 14 and 16 defining an internal chamber 18. An inlet 20 provides fuel to the burner 10, and a pair of mounting studs 22 are secured to the burner.

The upper and lower portions 14 and 16 are concavo-convex in shape and are substantially of the same configuration. The upper portion 14 includes a flange 24 around its outer peripheral edge that is bent or crimped around a flange 26 on the peripheral edge of the lower housing portion 16 thereby securing the two housing portions 14 and 16 together as a single unit. The completed crimp structure defines a flange or ledge 28 at the periphery of the burner 10.

An array of burner ports 30 are formed in the wall of the lower body portion 16 adajcent the flange 28. In use, fuel entering chamber 18 through inlet 20 flows through the burner ports 30 and once ignited forms a large area, H-shaped flame pattern. The flame is disposed below the ledge 28 so that stable flame retention is achieved.

Figure 2:
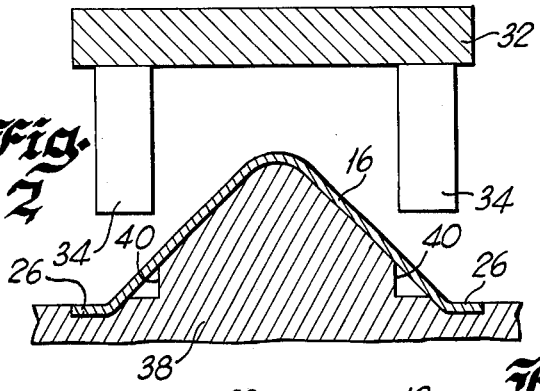
FIG. 2 is a cross-sectional view of the burner of the present invention and a simplified view of a tool for porting the burner.

Prior to assembly of the upper and lower housing portions 14 and 16, the ports 30 are formed in lower housing portion 16 in accordance with the present invention. The lower housing portion 16 is a formed sheet metal part and is positioned adjacent a tool 32 having a plurality of punches 34 mounted thereon (FIG. 2). The punches 34 are mounted on the tool 32 in an array corresponding to the array of ports 30 to be fabricated in the lower housing portion 16. Thus, one punch member 34 is provided on tool 32 for each port 30.

Figure 3:
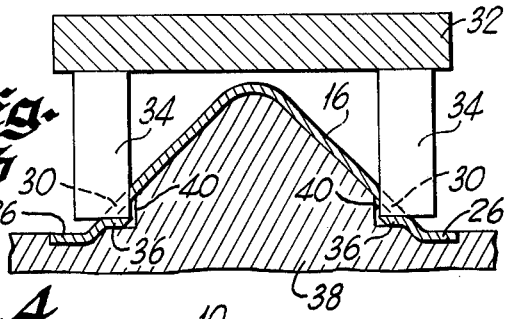
FIG. 3 is a view similar to FIG. 2 illustrating the engagement of the tool and burner.
Figure 4:
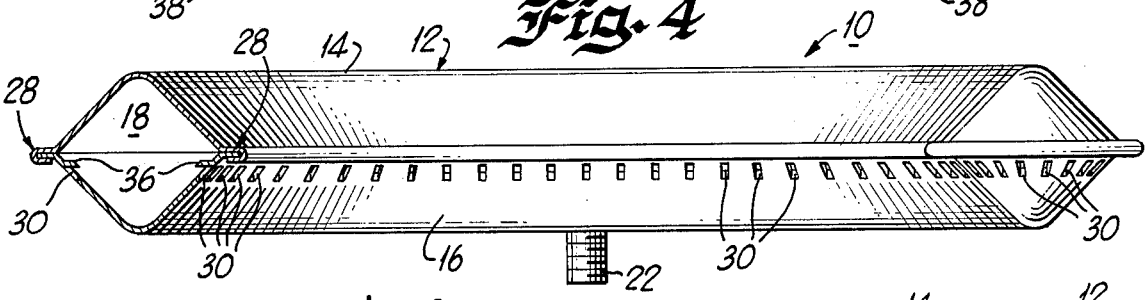
FIG. 4 is an enlarged view taken along line 4-4 of FIG. 1.
Figure 5:
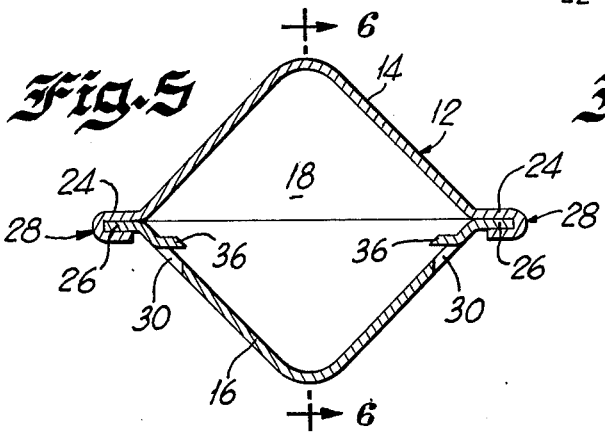
FIG. 5 is an enlarged view taken along line 5-5 of FIG. 1.
Figure 6:
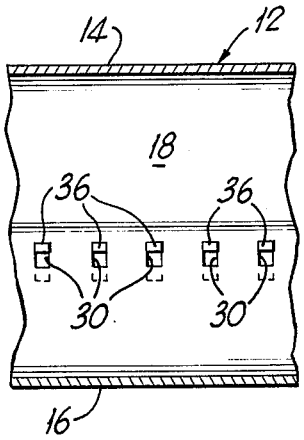
FIG. 6 is a view taken along line 6-6 of FIG. 5.

Despite the fact that ports 30 are typically narrow thus requiring a punch 34 that is narrow in a dimension parallel to the sides of housing 16, the travel of the punches 34 relative to the housing 16 allows the punches 34 to be larger in a dimension perpendicular to their path of travel (FIGS. 2 and 3). Accordingly, punches 34 are of sufficient strength to withstand the bending forces exerted against them as they pierce the inclined portions of housing 16. Furthermore, this extended dimension of the punches 34 provides no cutting edge to sever slugs or tabs 36.

Prior to the punching operation, the housing 16 is positioned upon support 38 that, in the embodiment illustrated, is of a configuration substantially similar to housing 16 except for notches 40 that correspond in size and location to the punches 34. Support 38 assists in preventing distortion of the housing 16 during the punching operation so that accurately sized ports 30 may be obtained. Moreover, notches 40 cooperate with punches 34 to form tabs 36 to the desired angle.

Once the lower housing 16 is positioned relative to the tool 32 and punches 34, the tool 32 is moved in a single operation toward the lower housing portion 16 (FIG. 3). When the punches 34 engage the body portion 16, the holes or ports 30 are punched into the lower housing portion 16 in the desired locations.

The movement of the tool 32 relative to the housing portion 16 is terminated as illustrated in FIG. 3 to form tabs 36 from the housing portion 16. A tab 36 is adjacent each port 30 and serves to direct gas flowing along the chamber 18 out of the port 30 in a generally horizontal direction to provide an efficient flame. If the tabs 36 were severed from the body 16, the gas flow would be in a more downward direction resulting in less desirable flame characteristics. In addition, the manufacturing operation would be complicated by the necessity for removing and handling the severed scrap material.

This method of port fabrication in a single movement results in a simple and economic procedure. As opposed to having separate punches on different tools moving at various angles relative to the body portion 16, or moving generally parallel to the flange 26, in the present invention, one tool may be employed and only a single motion is necessary.

In the preferred embodiment, each of the ports 30 is disposed in a part of the wall of body portion 16 which is inclined relative to the direction of tool movement. In addition, each port is adjacent the flange portion 26, and the flange portion 26 can be securely held against a supporting surface 38 during the porting operation.

Many modifications and variations of the present invention are possible in light of the above teachings. It should be understood that, within the scope of the appended claims, the invention may be practiced otherwise than as specifically described above.

What is claimed and desired to be secured by Letters Patent of the United States is:

1. A method of porting a fuel burner having a body of a complex shape wherein ports are to be formed in an array including more than a straight line, said method comprising the steps of:

providing on a tool structure a plurality of punch members in an array corresponding to the burner port array;

supporting the burner body and said tool structure for relative movement toward and away from one another with said punch members facing toward said burner body;

moving said tool structure and said burner body toward one another in order to form the entire array of ports in said burner body in a single relative movement of said tool structure relative to said burner body; and halting said relative movement at a desired depth leaving sheared slugs attached to the burner body and said slugs lying in parallel planes to direct fuel out of said ports.

2. A method of manufacturing a gas fuel burner comprising:

forming two sheet metal burner portions of similar complex shape, each burner portion being concavo-convex and having a flanged edge;

supporting said portion against a supporting surface;

aligning with said portion a tool having an array of punch members;

moving said tool into engagement with said portion so that said punch members cut into said portion at an angle to the plane of said portion to form a complete array of ports, said array being similar in shape to said flanged edge and each port being adjacent said flanged edge; and joining together the flanged edges of the two burner portions.

3. The method of claim 2, said moving step including discontinuing said moving before material is severed from said portion so that inwardly extending tabs are formed adjacent said ports.

4. The method of claim 2, said moving step including discontinuing said moving to control the desired port dimension.

* * * * *